US006983848B2

(12) United States Patent
Sherrell

(10) Patent No.: US 6,983,848 B2
(45) Date of Patent: Jan. 10, 2006

(54) IN-FIELD SELECTION AND CLARIFICATION OF HARVESTED PROCESSOR TOMATOES

(75) Inventor: Mark S. Sherrell, Selma, CA (US)

(73) Assignee: Woolf Enterprises, Huron, CA (US)

( * ) Notice: Subject to any disclaimer, the term of this patent is extended or adjusted under 35 U.S.C. 154(b) by 363 days.

(21) Appl. No.: 10/373,603

(22) Filed: Feb. 24, 2003

(65) Prior Publication Data

US 2004/0164004 A1 Aug. 26, 2004

(51) Int. Cl.
*B07C 5/08* (2006.01)

(52) U.S. Cl. ..... 209/557; 209/226; 209/580; 209/657; 209/587

(58) Field of Classification Search ..... 209/576–582, 209/656–658
See application file for complete search history.

(56) References Cited

U.S. PATENT DOCUMENTS

| | | | | | |
|---|---|---|---|---|---|
| 3,781,554 | A | * | 12/1973 | Krivoshiev et al. | 209/582 |
| 3,980,181 | A | * | 9/1976 | Hoover et al. | 209/565 |
| 4,088,227 | A | * | 5/1978 | Lockett | 209/581 |
| 4,120,402 | A | * | 10/1978 | Swanson | 209/558 |
| 4,281,764 | A | * | 8/1981 | Fowler, Jr. | 209/557 |
| 5,278,768 | A | * | 1/1994 | Brum | 700/223 |
| 5,279,426 | A | * | 1/1994 | Crismon et al. | 209/657 |
| 5,509,537 | A | * | 4/1996 | Crismon et al. | 209/577 |
| 5,979,667 | A | * | 11/1999 | Earl | 209/657 |
| 6,444,936 | B1 | * | 9/2002 | Ludwig et al. | 209/586 |

* cited by examiner

*Primary Examiner*—Donald P. Walsh
*Assistant Examiner*—Jonathan R. Miller
(74) *Attorney, Agent, or Firm*—Donald D. Mon

(57) ABSTRACT

A raw stream of freshly harvested processor tomatoes which includes desired crop, substandard crop and detritus is subjected to successive scannings and separations to produce an improved collection of tomatoes of increased value to the processor.

7 Claims, 2 Drawing Sheets

IN-FIELD SELECTION AND CLARIFICATION OF HARVESTED PROCESSOR TOMATOES

FIELD OF THE INVENTION

The in-field selection and clarification of a raw stream of processor tomatoes to remove debris and detritus and produce a more acceptable product for the processor.

BACKGROUND OF THE INVENTION

Many types of tomatoes, especially those intended for table consumption are picked from standing or supported vines which in turn support the tomatoes well above the ground. The harvested crop when it is harvested in the field is quite clean and well selected because when picked it is above the ground and clean, and carries with the tomato only a desired part of the stem, without dirt. These tomatoes are generally carefully handled, and arrive from the field clean and attractive.

There is another class of tomato that is grown principally to be processed, generally into a fluid product such as tomato paste, puree, or juice. These processor tomatoes are not intended to be served on the table as such. Their shape and structure in the sense of attractiveness to a diner or retail customer are of no importance. Instead they ultimately are processed into fluid products such as ketchup, tomato paste and dressings. The ultimate consumer will never see the original tomato, and probably never any one just like it.

It is not surprising that growing plants have been developed which produce tomatoes having a skin hardy enough to withstand mechanical picking and handling. One type, with which this invention is not concerned, grows to a height at which a mechanical harvester can pick the tomatoes from a standing vine as it passes along a row. This is a useful type, and can produce tomatoes which will be attractive to the diner. They are produced at the cost of trellissing and careful handling.

Another type, with which this invention is concerned, is more economical in the planting and growth of the vines, and which requires minimal attention during its growing season. Such vines, when growing their crop, first grow upwardly to a small height, and then droop over and down toward the ground, suspending the tomatoes within the vine structure. The vine actually covers and shrouds the tomatoes rather in a mound shape. These vines are planted as individual plants in rows, and are intended for least maintenance and harvest costs.

Such crops are grown in very large fields, often numbering in the hundreds of acres for one planting. Accordingly, large harvesters are needed and are used to harvest such crops. They grasp and pull the vine up out of the ground, sometimes severing the root (leaving it behind), and while suspending it shake the vine vigorously to release the tomatoes. The vine is left behind in the field, later to be plowed under, while the product of the shaking procedure is a "gathering" deposited on an elevator which carries it as a raw stream into the harvester for collection of the tomatoes.

Here the problems begin. A simple problem is the separation of green tomatoes from red tomatoes. This is regularly done by a color-responsive discriminator that divides the tomatoes into two streams—the red and the green. The color of the tomato has a particular relation to the usefulness of the tomato for specific ultimate products. Properties such as viscosity vary with the ripeness and color of the tomato.

A major problem is that the lifting of the vine to release the tomatoes also carries along some roots, branches, twigs, dirt, and dirt clods, collectively referred to herein as debris and detritus. When the vine is shaken over the elevator, some of this will accompany the tomatoes into the system. Also, some of the tomatoes will be heavily covered with dirt, which affects their perceived color.

In order ultimately to produce a processed product of suitable quality, the debris and detritus must be removed before the tomato part of the gathering can be accepted into the subsequent processing of the tomato into the fluid product. Of course this clarification of product can all be done later in the processing plant with the use of labor and much water, but it is costly, and the purchase price paid for the submitted product is reduced by the cost of the clarification. The task at hand is to reduce the need for clarifying the material to be delivered to the processor by doing as much of it as possible while the crop is still in the field, and in particular before it reaches the processing plant, which will surcharge a load for the trash it brings.

Some efforts are routinely made in the field for this purpose, and have been for a long time. Commercial harvesters are very large vehicles with carrying capacity for substantial accessory machinery and personnel. At the present time, when the initial stream exits the discriminator, it is dumped toward another moving conveyor belt. Tomatoes of a color to be rejected, perhaps green, are diverted, and the remainder flies to the belt. At this juncture some of the debris and detritus will fall away into the gap between these belts. Immediately downstream, one or two people stand alongside this belt and manually remove the debris and detritus which accompanies the tomatoes past the first discriminator and the gap. They also remove tomatoes of questionable or borderline quality which were incorrectly passed by the first discriminator.

This next manual function is very costly, but is affordable with present wage and cost schedules. In one major field operation, the cost of this manual function is about $1,200,000,00 per year. The use of this invention is expected to reduce this cost to less than $250,000,00 with equal or better results.

Besides being costly, the persons involved are themselves a limitation on the speed of the harvester. To speed the process beyond their capacity is not possible, because the incoming stream would only back up or undesirable product would be passed. The harvester itself must slow down to their rate.

Even more to the point, these persons are working in a noisy, dusty and hot environment, exercising selective judgement about what is to be left on the belt or removed from it. While the selection appears at first to be simplistic, it is not so simple after all. There must be a cognitive recognition of many shapes, sizes, colors and textures. Ultimately fatigue sets in and performance will be degraded.

The degradation can take many forms. The recognition of material to be rejected when viewed by a person involves neurological processes that unconsciously respond to various conditions of dirt, color, size, texture, and quality (freshness and broken product, for example). A very tired person can be expected to be less responsive to these, so that the results will vary from time to time for a given person, and also from person to person.

In contrast, a mechanical and electronic discriminator can be "set" to specific parameters, and it does not tire or vary in its response. This is not merely the substitution of a mechanical or optical device for the human responses. The substitution of a person by a sensor accomplishes more than the absence of fatigue or reduction of payroll. This invention, properly applied, results not only in a cleaner product with more value at the processor, but does so with a uniformity not attainable from the performance of a group of individuals. The ultimate performance is significantly improved, as evidenced by the cash value of the product.

It is an object of this invention to remove debris and detritus from a stream of freshly harvested processor type tomatoes at the harvester while in the field, and to produce a stream with greater cash value at the processing plant because the processing plant pays for the tomatoes on the basis of net useful product, taking into account the expense of cleaning up the product stream. Accordingly this invention significantly improves the cash value of the crop while producing a crop that requires less environmentally troublesome clarifying procedures.

BRIEF DESCRIPTIONS OF THE INVENTION

This invention is utilized in combination with a harvester that initially produces a gathering of tomatoes, debris, detritus, and dirt clods created by the vigorous shaking of an uprooted or severed tomato vine. A first discriminator separates green and red tomatoes from one another, but inherently passes at least some of the accompanying debris and detritus, and borderline tomatoes, which may be off-color, excessively dirty, or spoiled.

According to this invention, the product of the foregoing step is processed by a second discriminator which recognizes the previously passed tomatoes in clearer contrast to foreign material such as residual debris and detritus (including dirt). Such a second discriminator is not subject to human factors such fatigue and inattention. Instead, it relies on pre-set parameters that while selectible are consistent during any clarification process.

Suitable discrimination means for the second discriminator may include those which theoretically recognize and reject foreign material as such, assuming the remainder to be tomato, or in the alternative to recognize and pass tomatoes, rejecting all other materials. It will ordinarily include discrimination criteria which differ from those in the first step, because only potentially suitable tomatoes should have reached this second step. Closer attention to the color is no longer needed. Mostly, it is extraneous material that must be rejected by the second discriminator. However it is also possible to discriminate among various sizes of the same color of tomato, if desired.

Criteria for discrimination against materials other than the desired tomato can include size of the tomato, chaff, detritus, color, texture of the dirt, and dirt on the tomato.

The above and other features of this invention will be fully understood from the following detailed description and the accompanying drawings, in which:

DETAILED DESCRIPTION OF THE INVENTION

Figure 1:
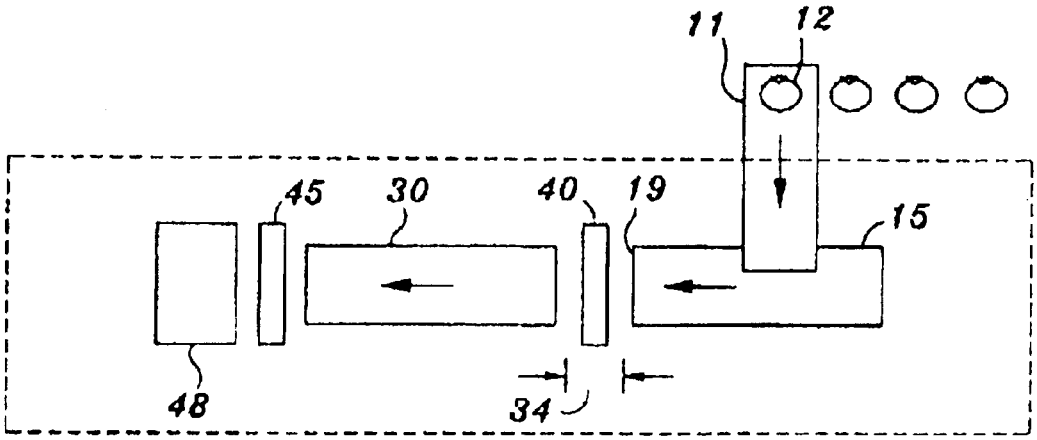
FIG. 1 is a schematic plan view of part of the invention.

The harvesting of processor type tomatoes begins with the uprooting of the vine, or the severance of the upper part of the vine from its roots. For this purpose the harvester grasps the vine and raises it over a belt type elevator 11 and shakes it heavily. As a consequence tomatoes 12 fall onto the elevator and are conveyed into the harvester as a raw stream of discrete bodies, namely tomatoes accompanied by whatever else may have shaken loose from the vine.

The vine itself is left in the field to be plowed under at a later time. The harvester moves along the rows from vine to vine. The resulting stream of collected material constitutes in addition to acceptable tomatoes, detritus and debris such as twigs and parts of the vine and its roots, and dirt in the form of clods or bits of roots with dirt attached. Obviously this material must be removed before the desired tomatoes that accompany it can be processed. If not, the processing plant will surcharge the delivered tomatoes for doing it.

To clarify the raw stream, as it is received from the elevator it is deposited on a first belt 15. Belt 15 is formed as a continuous loop with a top run 16. Run 16 will have a gradual downward slope of perhaps 10 degrees (often adjustable), and will move in the direction shown by arrow 17. Belt 15 has a bend 18 with a fall-off edge 19.

A receptacle 20 beneath and downstream from edge 19 will receive detritus 21 of such weight and shape that it will fall into it through a gap to be described.

A second belt 25 is disposed beneath belt 15 with a top run 26 that has an edge 27 whose function will be further described below. Its direction of movement is shown by arrow 28.

A third belt 30 is placed in alignment with belts 15 and 25. It is a continuous loop, with a top run 31 whose movement is shown by arrow 32. Third belt 30 has an edge 33 spaced from belt edges 19 and 27, leaving a gap 34 between them through which some discard material falls into receptacle 20.

A first discriminator 40 is disposed between the first and the third belt. Its function is to divide the gathered stream into a primary path 41 and a secondary path 42. The primary path is intended to contain all tomato product which is selected as the primary product. Of course it also will include some debris and detritus. Secondary path 42 is intended to contain rejected tomato material, which often will have usefulness of its own, for example green tomatoes when red tomatoes are sought as the product.

A third path 43 contains light debris and detritus which can fall from the primary and secondary stream into receptacle 20.

A second discriminator 45 is disposed adjacent to a second edge 46 of the third belt to pass acceptable tomato material to a collector 48 and reject remaining unacceptable tomatoes, debris and detritus 49 along a path 50 into a receptacle 51.

The generic task is straight-forward: receive the total stream on the first belt, then, at its edge 19 subject the gathering to the first discriminator. At that point the stream is divided. Because the first belt gives the stream a velocity, the primary path 41 has a trajectory dependent on the velocity. The first discriminator passes desired material such as red tomatoes, and also physically propels by paddlers 52 undesirable tomatoes and some trash onto secondary path 42, to the second conveyor belt, which carries this material away. Trash which is too light to have sufficient momentum falls along the trash path into receptacle 20.

Now the ultimately important events to this invention ensue. The stream which follows primary path 19 includes all of the desired ultimate product, and also the debris and detritus, and perhaps some improperly passed tomatoes, which was not propelled to the second belt. Generally this will include fairly large particles or clods, and undesirable tomato material.

It is alongside third belt 30 that persons have stood and manually removed trash and other undesired material. This belt conveys the stream which it received from primary path 41 to second discriminator 45. There the acceptable material is passed by the second discriminator, and the objectionable material is diverted by it to a collection point such as receptacle 51.

Discriminators suitable for use with this invention are well known and are in current use on tomato harvesters today. An example is the Golden Streak Tomato Sorter, a product made and sold by Woodside Electronics Corporation, located at 28 N. East Street, Woodland, Calif. 95776. These and other discriminators are designed to provide separation of desired tomato specimens, for example red or green tomatoes, from others, such as green or red tomatoes. The objective is to deliver a stream of tomatoes in a selected color range or size, for example. The rejected substances are disposed of, or treated, elsewhere.

This system is intended to make a macroscopic separation, and it can be expected that the stream from primary path 19 will be "contaminated" with debris and other undesirable material. That is why persons are employed to pick this material off of the third conveyor. The criteria for the first separation generally must involve more than merely color, and the pass through the first discriminator reduces much of the problem, but not enough.

Second discriminator 45 will again sense and pass the desired product, but importantly, there is more to be judged than merely color and size, otherwise the first discriminator would be sufficient. To understand the situation, the properties of the discriminators must be known. The description of one is sufficient for both.

Figure 3:
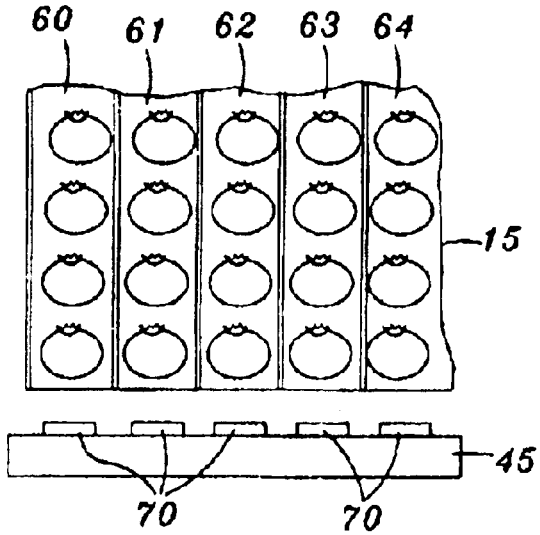
FIG. 3 is a fragmentary plan view of another portion of the invention.
Figure 2:
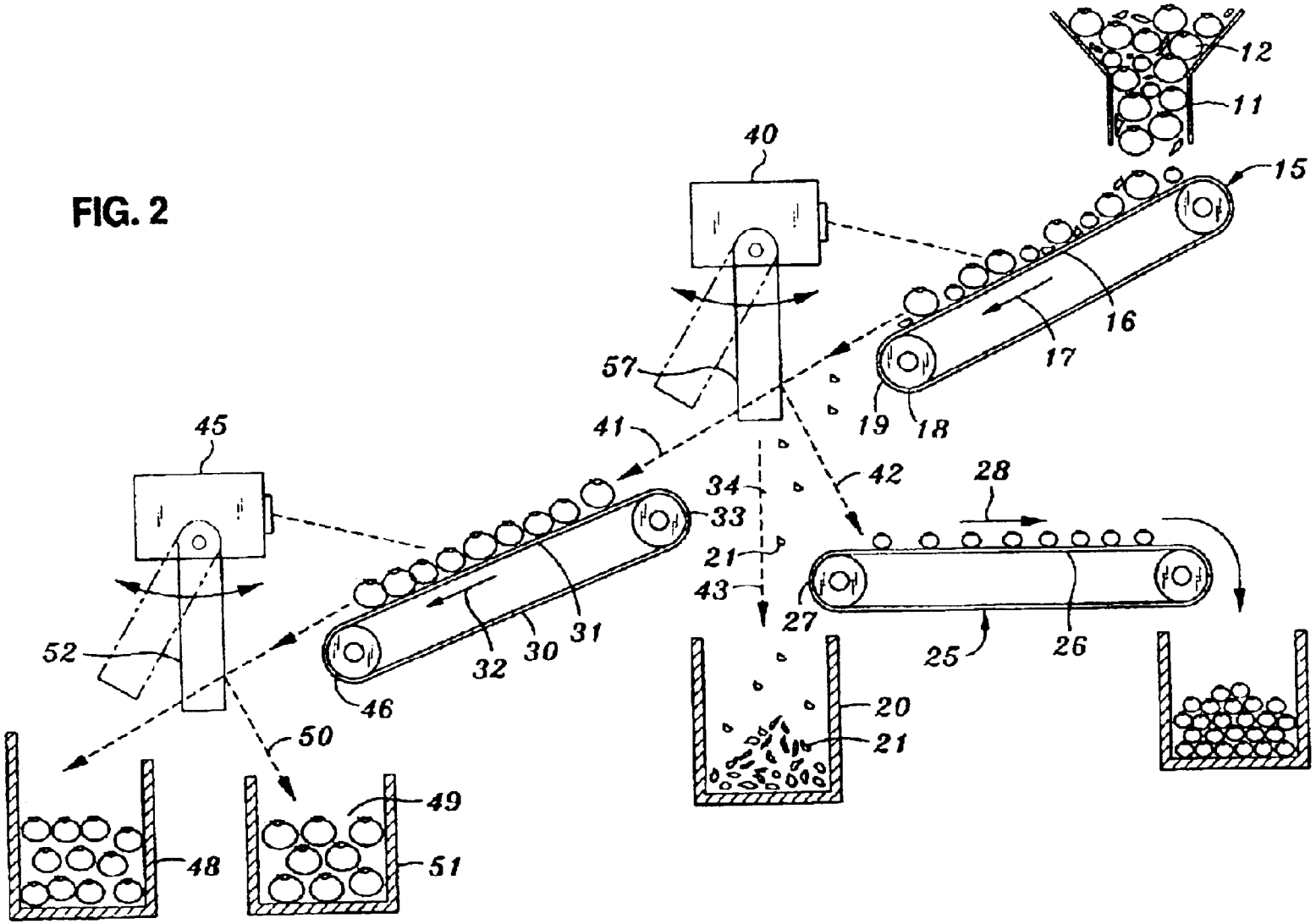
FIG. 2 is a schematic side view showing the presently preferred embodiment of the invention.

As best shown in FIG. 3, the discriminator responds to material delivered to it by belt 15 along a group of parallel paths 60–64. Generally each path is about one inch wide, so that a tomato will generally overlap at least two of them, while a clod of dirt may be presented in only one.

In whatever event, each channel has a sensor 70 responsive to reflection of energy such as visible or infrared light from material in its respective channel. If the response is that of acceptable material, nothing happens. The material flies to the third conveyor on the primary trajectory path 41 without interruption by the discriminator.

If the response is otherwise, then a paddle such as paddle 57 respective to its channel will be activated into the trajectory to impede the material and divert it to the secondary trajectory path 42. Path 42 leads to the second conveyor. Such material will usually be tomatoes of the "wrong", (unselected) color. For example if the intended crop is red tomatoes, the second conveyor may receive green tomatoes. Tomatoes with both colors will be directed to the conveyor receptive to the closest combination. It will also divert at least some of the heavier detritus and other undesirable material.

The first conveyor will have given its burden a sufficient velocity such that the first discriminator will be effective primarily in separating tomatoes. The third conveyor also gives its load a velocity. The criteria have separated the flow into two paths, plus the third path to the receptacle which receives lighter detritus which merely falls away.

A good discriminator, and the described one is an excellent example, actuates paddles to divert respective parts of the stream. The discriminator sensors are given settings to recognize certain features of tomatoes, dirt and detritus. These settings are adjustable, because a growing crop will from time to time change in the characteristics of a desired product. For example, a tomato crop starts out green and ultimately turns red, but all tomatoes on the same vine do not change color (ripen) at the same rate. This is a reason to discriminate on the basis of color. Both colors are useful, but not necessarily for the same ultimate processed product.

The available settings are usually color, dirt, chaff, sensitivity and delay and on the commercial device these are given numbered ranges for settings. While the same settings may be useful for both of the discriminators, usually there will be a difference, because each responds to a different product stream. The product stream to the second discriminator is a much-refined stream compared to that which the first discriminator faces.

Color. Tomatoes while maturing will pass through the color range from green through yellow, pink and red. Settings too close to green will exclude green but permit the other colors to pass. Settings too close to red could reject tomatoes of an acceptable color. The operator will, for both discriminators, select settings responsive to what he expects to harvest from the field he is working on.

Dirt. This is a setting which is very appropriate to this invention. In the first discriminator, color is the primary criteria. However, the dirt setting determines whether dirt will sufficiently be removed. If the setting is too high, it may reject desirable fruit which is merely dirty. Dirtiness can result from recent rains, for example. The general condition of the crop and the likelihood of clods are considerations in selecting the setting.

Chaff. This relates to detritus such as stems and pieces. One must be careful that if the system is too sensitive to chaff it might also reject good fruit. The operator must adjust this setting to meet the existing circumstances. For example, is there a reason why an unusually large amount of stems are present during a particular harvesting?

Delay. The system is heavily dependent on striking the tomatoes at the right time to deflect it along a different path. If the paddles strike too late, then more of the undesirable material will fly to the second belt.

Sensitivity. The reflected signal from an object must be bigger than a preset value. If the setting is sensitive to too small an object, dirt can overwhelm the signal from a large tomato. The object is to respond to sizes of interest to the ultimate product, only, to the extent that is possible.

With the above in mind, the advantages of this invention, and its operation, can be appreciated. In the first discriminator, the major separation of acceptable tomatoes from those with other uses or products is readily attended to. While dirt and detritus are of interest, the objective is finally to work on the intended type of tomato. Here is where humans have been used, literally to assess for each tomato its acceptability and the elimination of contaminant material.

In this invention the third conveyor delivers the pre-sorted tomatoes product to the second discriminator. At this point, the highly sophisticated second discriminator does its work.

The settings are made according to the day's crop and ground condition. Is the dirt wet or dry? The color response will be different, and so will the size of the clods, and perhaps of the condition or existence of stems and other chaff. There are adjustments that can be made on a running basis, so that an observer can be certain that the delivered product is correct. These settings provide for consistent response to conditions, and can be adjusted on a running basis if desired.

The addition of the second discriminator is not merely one of doing the same thing twice, or merely substituting a machine for a person. To the contrary, even when identical settings are use for both (which usually will not be the situation) the material on the third conveyor may contain materials that can be overlooked by a tired person, or subject to misjudgment.

Ordinarily there will be settings which refine the criteria. Here are two examples which have proved useful at different times and conditions in the harvesting.

| | Color | Dirt |
|---|---|---|
| Example I | | |
| First discriminator | 38 | 24 |
| Second discriminator | 12 | 50 |
| Example II | | |
| First discriminator | 36 | 24 |
| Second discriminator | 8 | 50 |

This invention is not to be limited by the embodiment shown in the drawings and described in the description, which is given by way of example and not of limitation, but only in accordance with the scope of the appended claims.

What is claimed is:

1. The method of clarifying, in the field, a harvested shaken raw stream of tomatoes of various colors, especially red and green, accompanied by debris and detritus derived from the mechanical separation of tomatoes from their vines, to produce a collection of tomatoes from the raw stream which meet pre-established discrimination criteria and to discard said debris, detritus and tomatoes of which are not within said discrimination criteria said method comprising:

a. receiving from the field said shaken raw stream and depositing it on a first conveyor;

b. while on said first conveyor, subjecting said raw stream to observation by a first discriminator, said first discriminator having the capability of individually recognizing and removing from said stream a substantial portion of articles which do not comply with said pre-established criteria;

c. on said first conveyor, moving said raw stream toward said first discriminator, said discriminator including a plurality of channels of observation of said raw stream, and a plurality of diverters individually adapted on command to physically pass or to divert material in its respective channel, whereby to pass potentially acceptable product to a third conveyor along a first trajectory path, or to deflect unacceptable material to a second conveyor along a second trajectory path, there being a gap between said first and third conveyors through which lighter components of said stream can fall away;

d. said third conveyor carrying said potentially acceptable product passed by said first discriminator away from said gap.

e. a second discriminator adjacent to said third conveyor including a plurality of channels of observation of the stream passed by said first discriminator, and a plurality of diverters individually adapted on command to physically pass tomatoes which are within said discriminator criteria, or to divert material other than tomatoes, and to pass tomatoes which are within said discriminator criteria to a place of collection.

2. The method of claim 1, further including said first conveyor having a delivery end which delivers said stream at a velocity to said first discriminator, said third conveyor having a receiving end to receive product passed by said first discriminator, and a second end adjacent to said second discriminator, said third conveyor delivering product from said first path to said second discriminator.

3. The method of claim 2, further including said second conveyor receptive of deflected material from said second path.

4. The method of claim 1 in which said first discriminator provides color recognition and dirt recognition, with sensitivity selection respective to color and to dirt.

5. The method of claim 4 in which the level of sensitivity to at least some of said characteristics are selected differently for said first and second discriminators.

6. The method of claim 1 in which the pre-established discriminator characteristic includes color.

7. The method of claim 6 in which the color discriminator is between green, yellow and red.

* * * * *